US006289971B1

(12) United States Patent
Kagawa

(10) Patent No.: US 6,289,971 B1
(45) Date of Patent: Sep. 18, 2001

(54) MOLD LEVEL CONTROL APPARATUS OF CONTINUOUS CASTING FACILITY

(75) Inventor: Toshiaki Kagawa, Saijou (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/482,002

(22) Filed: Jan. 13, 2000

(30) Foreign Application Priority Data

Jan. 14, 1999 (JP) ..... 11-008010

(51) Int. Cl.[7] ..... B22D 11/18
(52) U.S. Cl. ..... 164/449.1; 164/151.3
(58) Field of Search ..... 164/453, 449.1, 164/151.1, 151.3

(56) References Cited

U.S. PATENT DOCUMENTS 5,311,924 * 5/1994 Asano et al. ..... 164/453
5,913,357 * 6/1999 Hanazaki et al. ..... 164/453
5,921,313 * 7/1999 Niemann et al. ..... 164/453

FOREIGN PATENT DOCUMENTS 5-31560 2/1993 (JP) .
5-177321 7/1993 (JP) .
5-189009 7/1993 (JP) .
6-79423 3/1994 (JP) .
2598201 1/1997 (JP) .

* cited by examiner

*Primary Examiner*—Tom Dunn
*Assistant Examiner*—Len Tran
(74) *Attorney, Agent, or Firm*—Arent Fox Kintner Plotkin & Kahn

(57) ABSTRACT

A periodic disturbance restraining unit 23 is provided with a control component oscillating at a frequency equal to a frequency of a periodic disturbance of a mold level, calculates a mold level periodic disturbance restraining state amount by using a mold level control deviation signal from a control deviation calculating unit 21 and outputs a mold level periodic disturbance restraining signal. A control loop robust stabilization unit 24 receives a mold level steady-state deviation restraining signal from a steady-state deviation restraining unit 22 and the mold level periodic disturbance restraining signal, calculates an operating amount of a stopper so that a mold level control loop of the control apparatus is brought into robust stability and outputs an operating amount signal. A periodic disturbance frequency adapting unit 25 receives a mold level detected value signal and a casting speed detected value signal and detects an oscillatory frequency of the mold level as a periodic disturbance frequency and changes calculation characteristics of the periodic disturbance restraining unit and the control loop robust stabilization unit based on a result of the detection.

3 Claims, 8 Drawing Sheets

MOLD LEVEL CONTROL APPARATUS OF CONTINUOUS CASTING FACILITY

BACKGROUND OF THE INVENTION

The present invention relates to a continuous casting facility, particularly to a mold level control apparatus for controlling to maintain a molten steel level in a mold constant.

In an operation of a continuous casting facility, it is requested to realize a stable operation and to uniformly maintain cast slab at high quality. For this purpose, in the continuous casting facility, a function of maintaining a molten steel level in a mold constant plays an important role during the whole operation. The function is referred to as a function of "mold level control".

Molten steel accumulated in a tundish is guided from an opening portion disposed at a bottom portion of the tundish, via a pipe referred to as an immersion nozzle, to a rectangle mold. Molten steel injected into the mold is deprived of heat and cooled and an interface between the molten steel and the mold is solidified, a state of the molten steel is changed into slab and the slab is discharged to a downstream side. There is installed a part referred to as a stopper or a sliding gate (hereinafter, referred to as stopper) fabricated by refractory at a bottom portion of the tundish or a portion where the tundish and the immersion nozzle are bonded to each other. The stopper is installed to provide resistance to a flow of the molten steel in the immersion nozzle. The stopper comprises a structure in which the stopper can be moved by drive force such as hydraulic pressure. By adjusting the position of the stopper, a degree of the resistance provided to the molten steel flow in the immersion nozzle is changed. As a result, a flow rate of the molten steel in the immersion nozzle can be adjusted.

Ideally, when a volume per unit time of the slab cast by the continuous casting facility is balanced with the flow rate of the molten steel injected into the mold, the molten steel level in the mold is maintained constant. However, in operating the continuous casting facility, there is a case in which the stopper is melted since the stopper is exposed to the molten steel at a high temperature and a shape thereof is changed. Further, there is a case in which a deposit having a component of the molten steel is adhered to or exfoliated from a portion for passing the molten steel and the molten steel flow rate is changed. Further, there is a case in which an amount of the molten steel accumulated in the tundish is changed and delivery pressure of the molten steel at the opening portion of the immersion nozzle is changed. Further, there is a case in which a deposit of the molten steel is adhered to or exfoliated from the inside of the immersion nozzle and a molten steel guide path of the immersion nozzle is changed.

By these unsteady-state and unpredictable causes, even when the position of the stopper is maintained constant, the molten steel flow rate injected into the mold is changed. Further, the produced slab is discharged to the downstream side in a state in which the slab has not been completely solidified and accordingly, there causes a change in the shape of the slab by bringing the slab into contact with a supporting structure such as a plurality of rolls for transferring the slab. The change constitutes a factor of varying the mold level from the downstream side by flowing back the molten steel in an unsolidified portion in the slab.

In order to maintain the level constant in injecting the molten steel into the mold under such a situation, there is generally adopted a feedback control system as a mold level control system. According to the feedback control system, the mold is installed with a sensor for detecting the molten steel level in the mold. Further, the position of the stopper is adjusted so that an output value of the sensor is made to coincide with a target level provided as an instruction value.

Currently, there has been developed a new process of directly connecting a continuous casting facility with a hot rolling facility and integrally producing hot coils from refined molten steel. This is because there are requests for downsizing a facility scale and accordingly, a reduction in a facility cost as well as high efficiency formation of operation and a reduction in energy required for production. According to a continuous casting facility for playing an important role among these, there is the following request in addition to the above-described requests. That is, with a purpose of alleviating load on a hot rolling process, there are needed properties that a thickness of produced slab is as thin as 80 through 120 (mm) and the slab stays at a comparatively high temperature. In this way, since the slab thickness is comparatively thin, in order to provide priority in production capacity in comparison with that in a conventional facility, there is requested a casting speed as high as 5 through 8 (m/minute) for a continuous casting facility.

Since the slab thickness is thinned and the sectional area of the slab in the mold is smaller than that in the conventional facility, the adjusted molten steel flow rate is reflected sensitively to the mold level. Further, since temperature of the produced slab is high, the slab is extracted to the downstream side in a state in which the slab is softer than that in the conventional facility. As a result, a variation in the shape of the slab on the downstream side is more liable to be caused owing to the contact of the slab with a supporting structure such as rolls and the degree is magnified. As a result, the degree of fluctuation of the mold level derived from the downstream side is increased. Such a variation in the shape of the flexible slab is referred to as unsteady-state bulging. An explanation will be given as follows of serious influence effected by the unsteady-state bulging.

The inventors has constituted a mold level control apparatus by applying PI(Proportional Integral) control which is frequently utilized in a chemical plant as a feedback control system. In that case, when the operation is carried out at a specific casting speed, the inventors have faced a problem that the molten steel level in the mold which has been controlled excellently, abruptly starts oscillating at a frequency of about 0.3 (Hz), the oscillation finally increases and stable operation of the facility cannot be maintained.

When a surface of the cast slab is observed, a nonuniform distribution of the surface condition of the slab which coincides with an interval of rolls can be confirmed in a direction of moving the slab. Further, the oscillation frequency of the mold level substantially coincides with a value of a casting speed divided by the interval between the rolls. The inventors have acquired the knowledge that the oscillatory state of the mold level is caused as follows, from investigation and observation on a number of operational states.

(A) When a flexible slab at a high temperature is supported by the rolls, the slab constitutes a bulged shape in correspondence with the interval between the rolls.

(B) When such slab moves to the downstream side at a constant speed, a spacial nonuniformity of a condition of the slab such as an oscillation mark operates as, for example, frictional force and the slab starts pulsating. When intervals among a plurality of rolls stay equal, degrees of pulsation caused at the respective roll intervals are amplified mutually thereby.

(C) By the above-described pulsation, unsolidified molten steel in the slab flows back to the side of the mold to thereby constitute a periodic disturbance flow which is applied on the mold level. The periodic disturbance flow produces a level fluctuation in the mold at a frequency thereof. Thereby, there is produced a nonuniformity at the above-described period in cooling operation in the mold and the like. As a result, the cast slab is provided with a spacial nonuniformity at the above-described period in surface condition, a composition and the like.

(D) When a portion of the slab having the above-described condition (C) reaches a group of supporting rolls achieving the above-described operation of (B), the pulsation at the above-described period is further magnified. This is operated further to increase the degree of the periodic disturbance flow applied to the mold level. As a result, there is brought about a situation in which the oscillation of the mold level is increased and a stable operation of the continuous casting facility is hindered.

In this way, since the fluctuation in the mold level caused by the unsteady-state bulging of the flexible slab is self-increasing, it is extremely difficult to restrain the fluctuation.

As has been described previously, it is an object of the mold level control apparatus to restrain disturbance applied on an object of the mold level control to thereby maintain the mold level at a predetermined value. Generally, according to a control loop executed in Pi control, when steady-state disturbance in a step-like shape is applied, there is formed an operating amount for canceling the steady-state disturbance (instructed stopper position in the case of the mold level control) by an integration term present in a controller of the control loop. The phase of the integration term is retarded by 90 degrees and therefore, a correcting operation by the integration term is considerably retarded since the disturbance has been received. Further, in the control loop, there are factors for making the mold level control difficult such as delay time of the stopper position control, molten steel drop time and detection delay time of the sensor for detecting the mold level. According to a control object in which the correcting operation is delayed, when the gain of the integration term is set to be large, there is brought about a dangerous state in which the control loop is diverged and accordingly, the disturbance restraining operation in the PI control is limited.

In order to resolve the above-described problem caused by the PI control, conventionally, there have been proposed various mold level control methods (apparatus).

For example, according to Japanese Patent Laid-Open No. 31560/1993 (hereinafter, referred to as Related Art 1), there is disclosed "a level control method in a continuous casting" capable of maintaining the level always stable, swiftly and pertinently in correspondence with all of disturbances. According to the Related Art 1, a feedback control loop operates so that an actual value of the level is made to coincide with a target value of the level. A disturbance canceling control loop predicts a remaining difference amount of disturbance which cannot be feedback-controlled by a feedback control loop by using an instruction value outputted to an actuator, an actual value of the level and a level control model, adds a correcting signal for canceling the remaining difference amount to the instruction value and outputs an added value to the actuator.

According to the Related Art 1, the disturbance canceling loop is set at the inside of a control apparatus, the disturbance applied on an object of the mold level control is predicted and an operating amount is calculated by adding a correcting amount for canceling the predicted remaining difference amount of disturbance. Thereby, the predicted remaining difference amount of disturbance is equivalent to a value produced by differentiating a variation amount by the disturbance in a detected value of the mold level and the apparatus is operated to promptly restrain the fluctuation in the mold level caused by the disturbance.

Further, according to Japanese Patent Laid-Open No. 177321/1993 (hereinafter, referred to as Related Art 2), there is disclosed "a mold level control apparatus" for controlling the level in the mold in a continuous casting process with high accuracy. A control system of a mold level according to the Related Art 2 includes a sliding nozzle or a stopper (hereinafter, referred to as sliding nozzle) for operating an amount of injecting molten steel, a level meter for measuring the molten steel level in the mold and a mold level control apparatus for calculating an opening degree of the sliding nozzle. The mold level control apparatus is provided with a data processing unit for inputting a measured value of the mold level and a set value of the mold level as data input and executing a dynamic compensation calculation at a higher order and a control instruction outputting unit for switching control output after elapse of a predetermined time period.

According to Japanese Patent Laid-Open No. 189009/1993 (hereinafter, referred to as Related Art 3), there is disclosed "a control apparatus" remarkably improving response performance in a control system in which delay time and periodic variation (disturbance) are included. The control apparatus disclosed in the Related Art 3 is a higher order dynamic compensation type control apparatus featured in including a data processing unit for inputting a measured value of the level and a set value of the level as data input and executing a dynamic compensation calculation at a higher order and a control instruction outputting unit for switching the control output after elapse of a predetermined time period.

In the Related Arts 2 and 3, the mixed sensitivity problem in the $H\infty$ (infinitive) control theory is applied to the mold level control and a mold level controller is constituted by a special linear filter having a higher order number. Thereby, there is provided a controller having a disturbance restraining function more excellent than that in a simple Pi controller. Further, the robust stability of the mold level control loop is ensured by setting an upper limit of process perturbation and ascribing the control to the mixed sensitivity problem.

According to Japanese Patent Publication No. 2598201 (hereinafter, referred to as Related Art 4), there is disclosed "a control apparatus of a level in a mold of a continuous castor" capable of self-controlling, at an early stage, hunting of the level of the molten steel in the mold influenced by a change in a control parameter or the application of the disturbance or the like. The Related Art 4 is a control apparatus in which in producing a cast block by extracting it from a tundish while maintaining constant the level of the molten steel in the mold, an amount of injecting the molten steel into the mold is controlled so that a detected mold level is made close to a target value of the level. According to the control apparatus, there is assumed a controlled state region constituted by a control state comprising a deviation between the target value and the detected value of the level and a first order differential value of the deviation. The control apparatus is provided with a controller, a control gain setting section and an injected molten steel amount controlling section. According to the controller, there can be set a characteristic in which a weighted sum of the deviation and the first order differential value of the deviation is nullified in order to divide a predetermined control state region in the control state region. According to the control gain setting section, the controller is provided with control gains for making control states in the respective control state regions close to the characteristic at the respective control state regions. According to the injected molten steel amount controlling section, the amount of injecting the molten steel is controlled by using the controller based on the control gain of the control state region to which a detected control state pertains.

According to the Related Art 4, the controllers having different control gains which are set so that the weighted sum of the deviation in controlling the mold level and the temporal differential value of the deviation is nullified, are controlled to switch according to the respective control state regions to thereby constitute an application mode of a variable structure control system. The variable structure control system is provided with a preferable property having a high robust performance by constraining a control state onto a stable switch face with a high gain.

According to Japanese Patent Laid-Open No. 79423/1994 (hereinafter, referred to as Related Art 5), there is disclosed "a level control method in a continuous casting" for restraining a fluctuation in the level by realizing stable and excellent level control in respect of unsteady-state disturbance such as bulging or nozzle clogging or exfoliation, parameter error or parameter variation or observed noise which requires a swift response performance.

According to the Related Art 5, there are respectively set a first weight function for reducing a magnitude of a transfer function covering from a disturbance causing level variation to a level control output in a desired frequency region, and a second weight function for reducing a magnitude of a transfer function covering from the disturbance to a point prior to applying the disturbance in a desired frequency region. Further, there are described a state equation and an output equation with the weight functions and control output, a control operating amount and an estimated value of disturbance as state variables. Further, by applying the H∞ control theory thereto, a feedback calculation signal is calculated and a sum of the feedback calculation signal and the correcting signal for canceling a disturbance amount is applied to an actuator for controlling an amount of flowing the molten metal into the mold. The Related Art 5 is provided with a disturbance amount estimating mechanism similar to the above-described Related Art 1. Accordingly, the control method is operated to cancel the variation amount of the mold level by disturbance. Further, the robust control function of the control loop is promoted by combining with an H∞ controller.

However, there pose the following problems in the above-described Related Arts 1 through 5.

First, the disturbance estimating mechanisms of the Related Arts 1 and 5 are constituted as observers at a lower order. Therefore, when the process receives a perturbation at a higher order, there is a concern of causing a phenomenon referred to as spill over in which the disturbance estimating mechanism itself oscillates at a high frequency. In order to prevent the spill over, a disturbance estimating gain is obliged to set to be small. Accordingly, a disturbance estimating result is retarded more than an actual disturbance change and the effect of the disturbance estimating mechanisms is limited.

Similarly, also in the case of the Related Art 4, the switch face of the variable structure control system is constituted by a simple linear combination of the control deviation and the temporal differential value of the deviation. Therefore, there is a concern of causing spill over. The spill over of the variable structure control system emerges as a phenomenon in which the control state of the object of the mold level control cannot be constrained onto the switch face and is diverged. Further, in the case of the Related Art 4, the control gains of the controller are switched at short time intervals by reciprocating the control state of the control object at the switch face and there causes a phenomenon of chattering in the temporal transition of the operating amount.

Further, in the cases of the Related Arts 2 and 3, the upper limit of the process perturbation is set and accordingly, the robust stability of the mold level control loop can be ensured and the above-described spill over is not caused. However, the H∞controller of the mixed sensitivity problem in which the detected value of the mold level constitutes the input and the instructed position of the stopper constitutes the output, is not so much different from a PID controller which is tuned optimally in view of the frequency characteristic. Therefore, the inventors have an opinion that the control function is not so much different from that of the PID controller which is tuned optimally.

As described above, the fluctuation of the mold level caused by the unsteady-state bulging of the flexible slab is self-increasing and accordingly, it is difficult to restrain the fluctuation by a control apparatus having a more or less disturbance restraining function.

SUMMARY OF THE INVENTION

Therefore, it is one object of the invention to provide a mold level control apparatus capable of controlling a mold level stably and constantly even when the mold level control apparatus undergoes an influence of the periodic disturbance, described above.

It is the other object of the invention to provide a mold level control apparatus capable of restraining the self-increasing periodic disturbance in the fluctuation of the mold level by strong disturbance restraining function even when the mold level control apparatus is applied with the periodic disturbance at a specific frequency.

The mold level control apparatus according to the invention is provided with a mold level detector for detecting a mold level in a mold and outputting a mold level detected value signal indicating a mold level detected value and controls a stopper or a sliding gate to maintain constant the mold level in a continuous casting facility.

According to an aspect of the invention, the mold level control apparatus includes a control deviation calculating unit for calculating a mold level control deviation by the use of a mold level instruction value signal and the mold level detected value signal, and outputting a mold level control deviation signal. A steady-state deviation restraining unit receives the mold level control deviation signal and calculates a mold level steady-state deviation restraining state amount, and outputs a mold level steady-state deviation restraining signal. A periodic disturbance restraining unit is provided with a control component oscillating at a frequency equal to a frequency of periodic disturbance of the mold level, receives the mold level control deviation signal and calculates a mold level periodic disturbance restraining state amount, and outputs a mold level periodic disturbance restraining signal. A control loop robust stabilization unit receives the mold level steady-state deviation restraining signal and the mold level periodic disturbance restraining signal, calculates an operating amount of the stopper or the sliding gate so that a mold level control loop of the mold level control apparatus is brought into robust stability and outputs an operating amount signal. A periodic disturbance frequency adapting unit receives the mold level detected value signal and a casting speed detected value signal and detects an oscillatory frequency of the mold level as the frequency of the periodic disturbance and changes calculation characteristics of the periodic disturbance restraining unit and the control loop robust stabilization unit based on a result of the detection.

BRIEF DESCRIPTION OF THE DRAWINGS

FIG. 7A and FIG. 7B are Bode diagrams for explaining operation of a steady-state deviation restraining unit and a periodic disturbance restraining unit in which FIG. 7A is a diagram showing a gain characteristic and FIG. 7B is a diagram showing a phase characteristic;

FIG. 8A and FIG. 8B are Bode diagrams for expressing the robust stability of a mold level control loop in respect of perturbation of the control object of the mold level according to the invention in which FIG. 8A is a diagram showing a gain characteristic and FIG. 8B is a diagram showing a phase characteristic;

FIG. 9A and FIG. 9B are Bode diagrams showing disturbance restraining function of the mold level control apparatus according to the invention in which FIG. 9A is a diagram showing a gain characteristic and FIG. 9B is a diagram showing a phase characteristic.

DETAILED DESCRIPTION OF THE PREFERRED EMBODIMENTS

An explanation will be given of a conventional feedback control model to facilitate to understand the invention in reference to FIG. 1. The following explanation may be regarded as a summary of the Related Arts 1 through 5, mentioned above. An explanation will be given here of a case in which the control object is a stopper.

Figure 1:
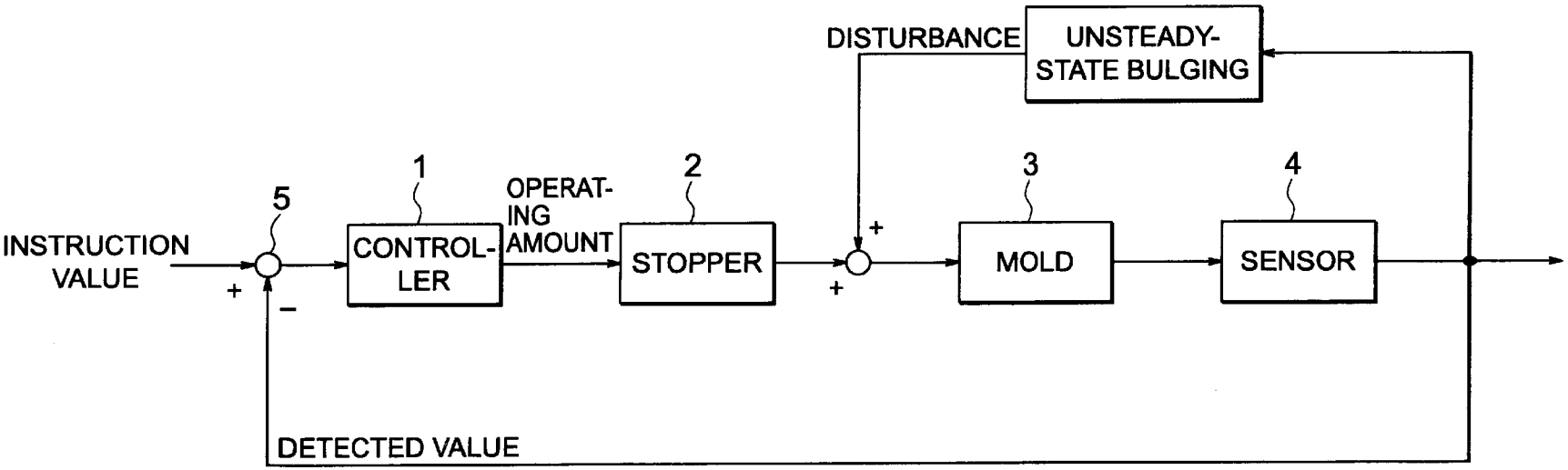
FIG. 1 PRIOR ART
FIG. 1 is a block diagram for explaining a self-increasing fluctuation of a mold level by a conventional control model.

In FIG. 1, a controller 1, a stopper 2, a mold 3 and a sensor 4 for detecting the level of the mold 3 are connected in series. A detected value detected by the sensor 4 is fed back to a subtracter 5. The subtracter 5 provides a deviation between an instruction value and the detected value of the mold level of the mold 3 to the controller 1. The controller 1 controls the stopper 2 so that the deviation is nullified.

In FIG. 1, there is added a disturbance caused by unsteady-state bulging as a factor for fluctuating the level of the mold 3. That is, as shown by FIG. 1, a self-increasing mold level fluctuation is represented by a control model in which there is provided a feedback loop of an unsteady-state bulging characteristic of disturbance-mold 3-sensor 4-unsteady-state bulging-disturbance. In such a control model, in order to resolve the self-increasing fluctuation, there must be calculated and outputted an operating amount of the stopper 2 to cancel the disturbance by a disturbance restraining function larger than a feedback gain of the feedback loop.

However, according to the control apparatus, when the disturbance is intended to be cancelled, the operating amount of the stopper 2 is increased (control gain is obliged to be set high) and the control loop itself becomes unstable.

An explanation will be given of preferable embodiments according to the invention as follows.

First, an explanation will be given of a procedure of study underlying the invention. In the following, the description will be given in such a way that a stopper is used for adjusting an injection amount of molten steel in the mold level control. Naturally, the invention can similarly be realized also in the case of using a sliding gate in place of the stopper.

In view of the control theory, the periodic disturbance flow caused by a pulsation of a flexible slab produced by rolls on the downstream side of the mold can be regarded as a kind of a resonant narrow band pass filter. The oscillatory state of the mold level, described above, can be represented by a block diagram shown by FIG. 3. In this control loop, a mold level control apparatus 20 receives a deviation between a level instruction value "r" which is instructed and a detected value "y" of the mold level. The mold level control apparatus 20 calculates and outputs an operating amount "u" of the stopper so that the deviation is nullified.

The detected value "y" of the mold level under control receives a variation by noise. Temporal transition of the detected value "y" of the mold level which is initially varied irregularly, is subjected to a filtering having a sharp peak at a characteristic frequency. Thereby, an oscillation component of the resonant narrow band pass filter is stimulated and a periodic disturbance flow $Q_d$ oscillating at the frequency is produced. Further, the periodic disturbance flow $Q_d$ is fed back as a disturbance flow rate "d" flowing into the mold.

Figure 4:
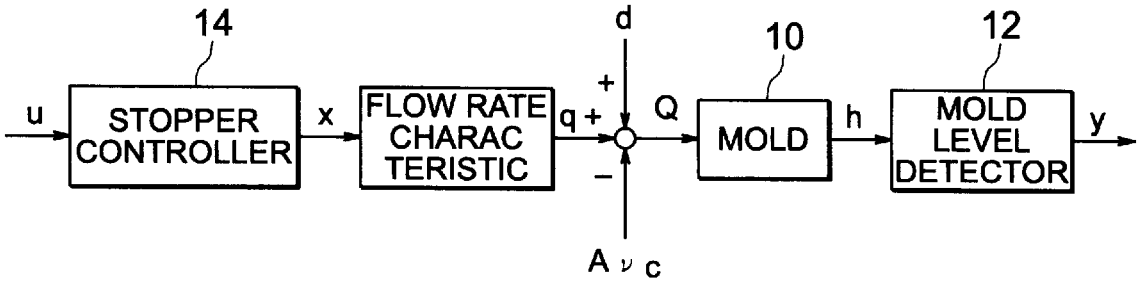
FIG. 4 is a diagram representing a control object of the mold level by a block diagram.

FIG. 4 is a diagram representing a control object of the mold level by a block diagram. A stopper controller 14 moves the stopper by an actuator so that a stopper position "x" becomes equal to a stopper operating amount "u". The actuator is realized by, for example, a hydraulic cylinder. A flow rate "q" of the molten steel passing through a clearance between a front end of the stopper and a perforated portion at the bottom portion of the tundish, is changed depending on the stopper position "x". A relationship between the stopper position "x" and the molten steel flow rate "q" is referred to as a flow rate characteristic. There flows molten steel at a molten steel flow rate Q having a volume per unit time superposing the flow-in disturbance flow rate "d" on a value constituted by subtracting a product of a casting speed vc by a mold sectional area A (that is, a volume per unit time of produced slab) from the flow-in molten steel flow rate "q", into the mold 10. A volume produced by integrating the molten steel flow rate Q flowing into the mold 10 over time, constitutes a volume of the molten steel in the mold. A space in the mold 10 is generally described by a rectangular parallelepiped and accordingly, an amount produced by dividing the volume of the rectangular parallelepiped by the mold sectional area A constitutes a mold level "h". The mold level "h" is detected by a mold level detector 12 as the detected value "y". The mold level detector 12 is realized by, for example, an eddy current type distance sensor.

It is assumed that all of respective elements of FIG. 4 can be represented by mathematical models of linear ordinary differential equations, that is, rational functions (transfer functions) of Laplace operator "s". A mold level control apparatus 20 also outputs the stopper operating amount "u" by executing a numerical value calculation represented by a transfer function. The transfer function is designated by notation K.

There are assumed as the transfer functions of the respective elements of FIG. 4, a transfer function of the stopper controller 14, a transfer function of the stopper flow rate characteristic, a transfer function of the integrating operation in the mold 10 and a transfer function of the mold level detector 12. A transfer function represented by a product of all of these is designated by the notation P and the notation P designates a transfer function of the mold level control object.

The molten steel flow rate "q" is a state amount adjusted by the mold level control apparatus 20. Meanwhile, the disturbance flow rate "d" flowing into the mold is a state amount mixed from the outside of the control loop and cannot be controlled by the mold level control apparatus 20. In this case, in the control loop, a transfer function S of from the disturbance flow rate "d" to the molten steel flow rate Q flowing into the mold 10 is represented by the following equation.

$$S=1/(1+L) \tag{3-1}$$

Notation S designates the transfer function referred to as a sensitivity function of the control loop. Here, notation L designates a transfer function given by a product of elements in the control loop, that is, L=K·P. This is referred to as an open-loop transfer function. By the above-described, the following equation is established.

$$Q=S\cdot d+A\cdot v_c \tag{3-2}$$

When the mold level control apparatus 20 ideally restrains the flow-in disturbance, the molten steel flow rate Q flowing into the mold 10 coincides with a volume of producing the slab per unit time and the mold level is maintained constant. According to Equation (3-2), S=0. Although actually, the amount S cannot be nullified, it is apparent that in order to reduce influence of the disturbance flow rate "d" flowing into the mold, the amount S needs to be reduced.

In investigating the frequency response of the amount S, the amount S is of a complex function of a frequency of "w". By the above-described, the smaller the absolute value of the frequency characteristic value of the amount S, that is, the smaller the value of the gain, the smaller the influence of the flow-in disturbance can be made.

Figure 3:
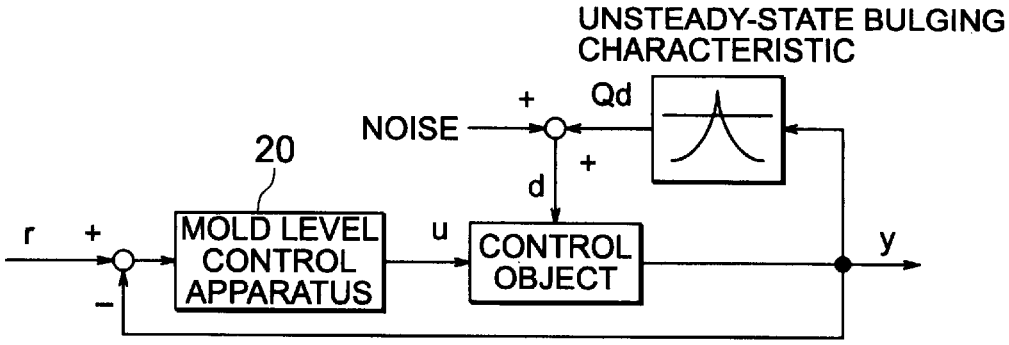
FIG. 3 is a block diagram for explaining an oscillatory state of the mold level.

It is apparent from the above-described that in the mold level oscillatory state investigated in reference to FIG. 3, there is a need of restraining the influence of the disturbance flow rate flowing into the mold which is fed back to the control loop by reducing the frequency characteristic of the sensitivity function S in constituting the control loop at the problematic periodic disturbance frequency. Thereby, the temporal transition of the mold level detected value in constituting the control loop, is removed of the component of the disturbance flow rate flowing into the mold at the periodic disturbance frequency, and the oscillatory component of the resonant narrow band pass filter representing the unsteady-state bulging is not stimulated. As a result, the self-increasing fluctuation of the mold level can be resolved. In the following, a description will be given of the characteristic of the transfer function K of the mold level control apparatus 20 realizing the sensitivity function S which is needed.

As shown by Equation (3-1), the sensitivity function S is derived from the open-loop transfer function L of the control loop and the open-loop transfer function L appears in the denominator of Equation (3-1). That is, it seems that by increasing the gain of the open-loop transfer function L at the periodic disturbance frequency, the absolute value of the denominator of Equation (3-1) can be increased and the gain of the sensitivity function S can be reduced at the periodic disturbance frequency.

The open-loop transfer function L is constituted by the product of all of the transfer functions of the elements in the control loop and cannot be adjusted by other than the transfer function K of the mold level control apparatus 20 and accordingly, the gain of the transfer function K itself of the mold level control apparatus 20 may be set to be high at the periodic disturbance frequency. Specifically, an oscillatory property of resonating at the periodic disturbance frequency may be provided to the transfer function K of the mold level control apparatus 20.

In the following, there is derived the transfer function K of the mold level control apparatus 20 so that the gain is increased at the periodic disturbance frequency. According to the method, an oscillatory component of resonating at the periodic disturbance frequency is added to the transfer function K of the mold level control apparatus 20, the control loop is shaped by applying the H∞ control theory and at the same time, the robust stability is ensured.

Figure 5:
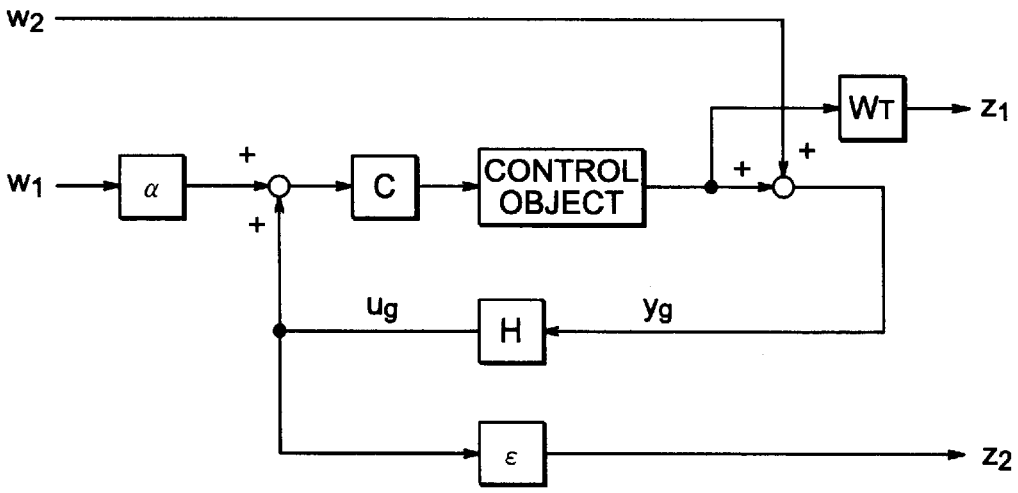
FIG. 5 is a diagram showing a constitution example of a generalized plant in studying an H∞ controller according to the invention.

FIG. 5 shows a constitution example of a generalized plant in studying an H*c* controller. In FIG. 5, notations $w_1$ and $w_2$ designate input state amounts, and notations $z_1$ and $z_2$ designate output state amounts in respect of a generalized plant in applying the H∞ control theory. Notations $\alpha$ and $\epsilon$ designate positive constants. Notation C designates a transfer function for increasing gain of the transfer function K of the mold level control apparatus 20 at a specified frequency. Notation $W_T$ designates a transfer function for avoiding influence of uncertainty (modeling error) of, for example, a time period for moving the molten steel through the immersion nozzle (generally referred to as molten steel drop time) or a dead band of the stopper actuator. Further, notation H designates a transfer function which is calculated by solving the H∞ control problem and notations $u_g$ and $y_g$ designate state amounts representing control input and control output of the generalized plant.

Assume that the H∞ control problem represented by Equation (3-3), shown below, in the above-described generalized plant is solved to thereby provide the transfer function H.

$$\left\| \begin{matrix} T_0 W_T \\ \alpha W_T P C S_i \end{matrix} \right\|_\infty < 1 \tag{3-3}$$

Then, the desired transfer function K of the mold level control apparatus 20 can be provided as follows.

$$K=C\cdot H \tag{3-4}$$

In Equation (3-3), notations $S_i$ and $T_o$ designate a sensitivity function and a complementary sensitivity function of a generalized plant control loop shown by FIG. 5.

In the following, embodiments of the invention will be described while showing specific transfer functions. Further, although a simplest mathematical model is used for convenience of explanation to facilitate the constitution of the invention, the invention is not limited thereto. It seems that when respective transfer functions are represented more complicatedly, there can be constituted the mold level control apparatus 20 having high function and high accuracy. However, it will be commented beforehand that the constitution is easily conceivable without exceeding the framework of the invention.

Figure 6:
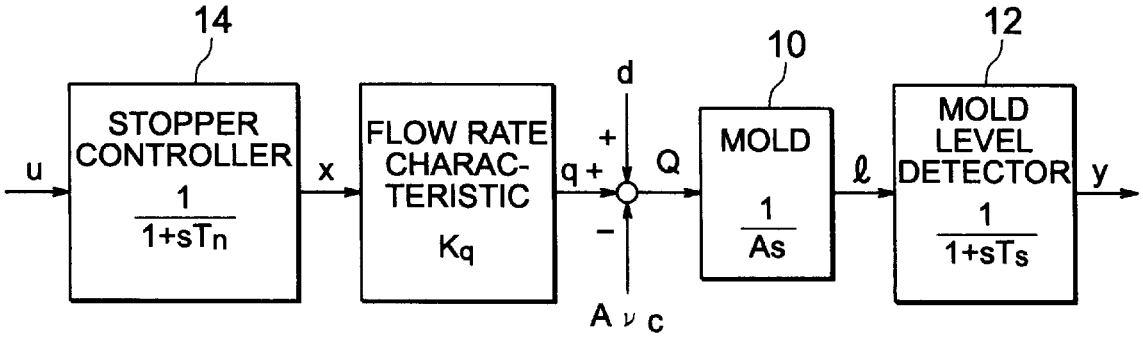
FIG. 6 is a block diagram applying a specific transfer function to the control object of the mold level shown by FIG. 4.

FIG. 6 shows a block diagram applying specific transfer functions to the control object of the mold level shown by FIG. 4.

In FIG. 6, notations $T_n$, $K_q$, A and $T_s$ respectively designate an operational delay time of the stopper actuator, a flow rate gain of the stopper, a sectional area of the mold and an operational delay time of the mold level detector 12 and constitute parameters which are invariable over time. Thereby, the transfer function P of the control object of the mold level is as shown below.

$$P=K_q/\{A\cdot s(1+s\cdot T_s)\cdot(1+s\cdot T_n)\} \tag{3-5}$$

The transfer function C for increasing the gain of the transfer function K of the mold level control apparatus 20 at a specific frequency is as shown below.

$$C=\{\omega_n^2/(s^2+2\cdot\zeta\cdot\omega_n\cdot s+\omega_n^2)\}+1/(T_i\cdot s) \tag{3-6}$$

The first term in Equation (3-6) indicates an oscillation (or resonation) component resonated by a periodic disturbance and notation $\omega_n$ designates a periodic disturbance oscillation frequency. Notation $\zeta$ designates a damping coefficient of the oscillatory component which achieves an operation of adjusting the gain of the amount C at the frequency $\omega_n$. The smaller the amount $\zeta$, the higher the gain of the amount C at the frequency $\omega_n$ becomes. Further, the second term in Equation (3-6) is introduced to carry out the same operation as that of the integration term in the PI controller, that is, to nullify the steady-state deviation in the mold level control.

Figure 7A:
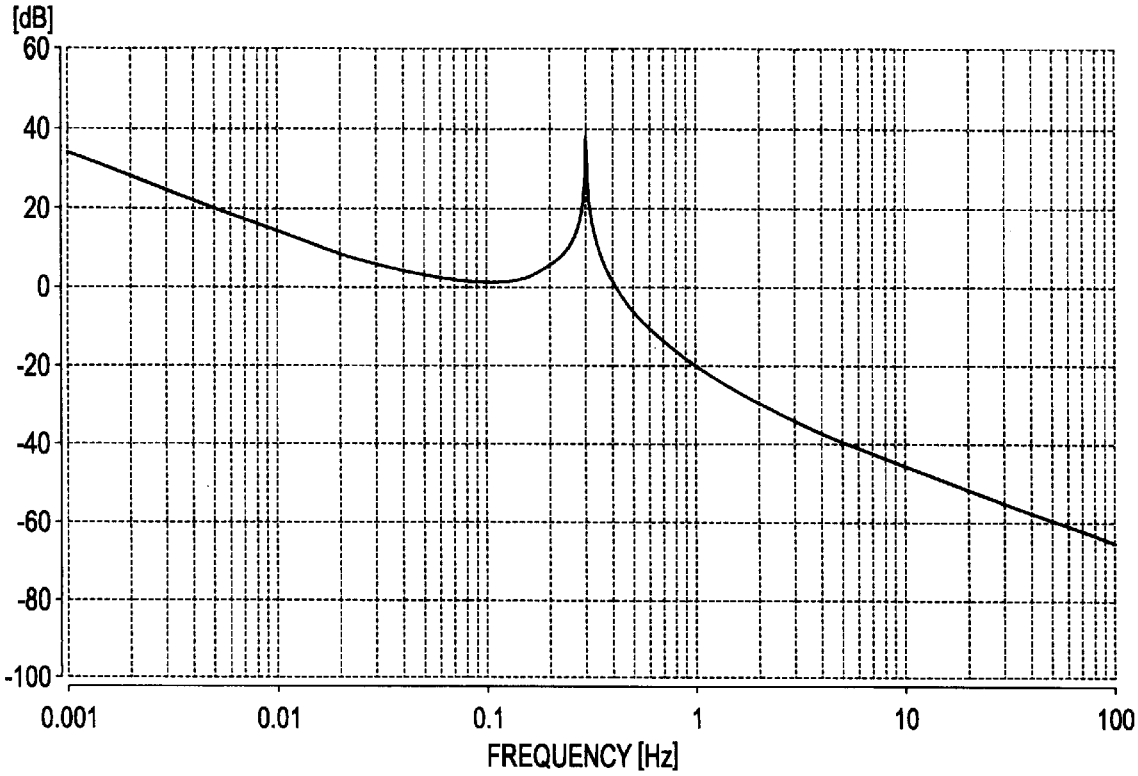
Figure 7B:
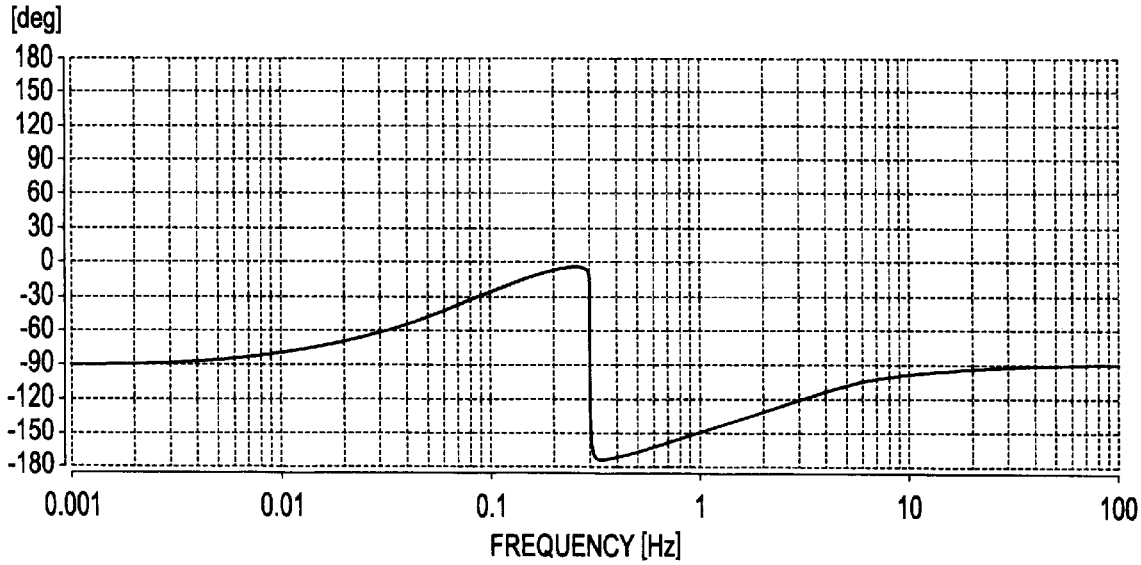

FIGS. 7A and 7B show a result of plotting the frequency characteristic of the amount C by a Bode diagram.

In order to avoid the influence of the modeling error, the transfer function $W_T$ may be defined so that the term of $W_T\cdot P\cdot C$ becomes proper in Equation (3-3). For example, $W_T$ is defined as follows.

$$W_T=T_1\cdot(1+s\cdot T_2)\cdot(1+s\cdot T_3) \tag{3-7}$$

In Equation (3-7), notations $T_1$, $T_2$ and $T_3$ designate adjusting parameters and the gain curve of the frequency response of the amount $W_T$ may be defined to cover a gain curve of the frequency response of multiplicative perturbation $\Delta_m$ of the mold level control object P (a transfer function P' of the perturbed mold level control object is expressed as $P'=(1+\Delta_m)\cdot P$).

Figure 8A:
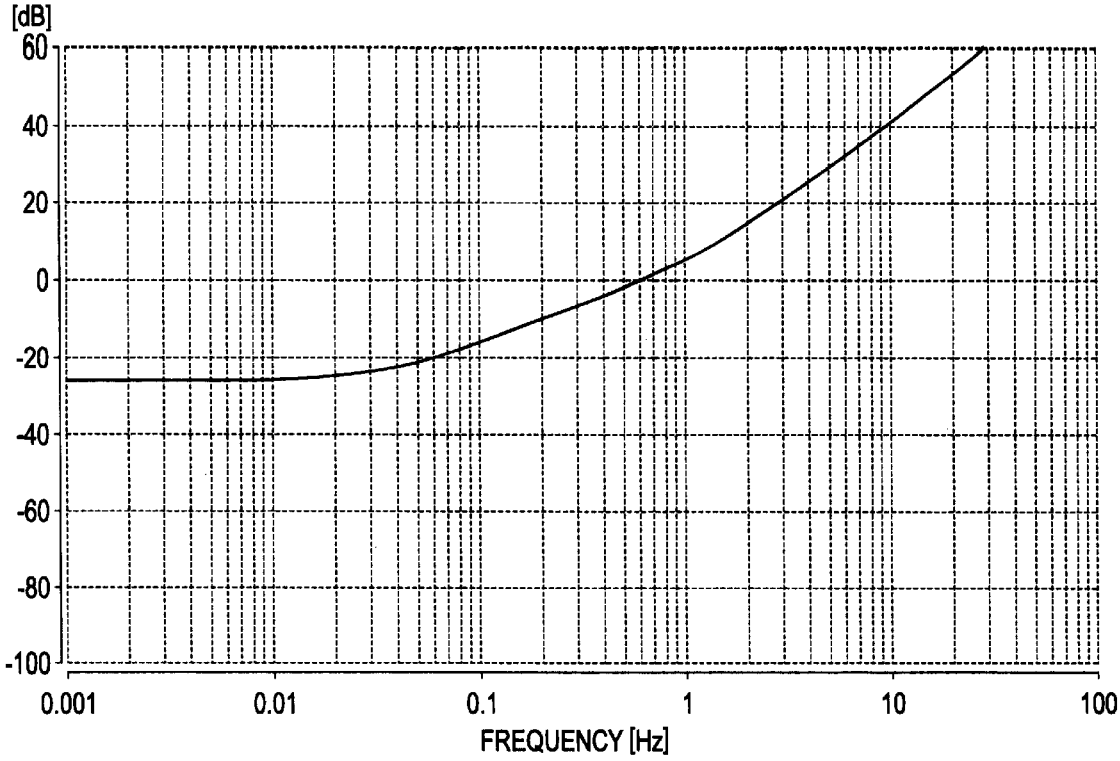
Figure 8B:
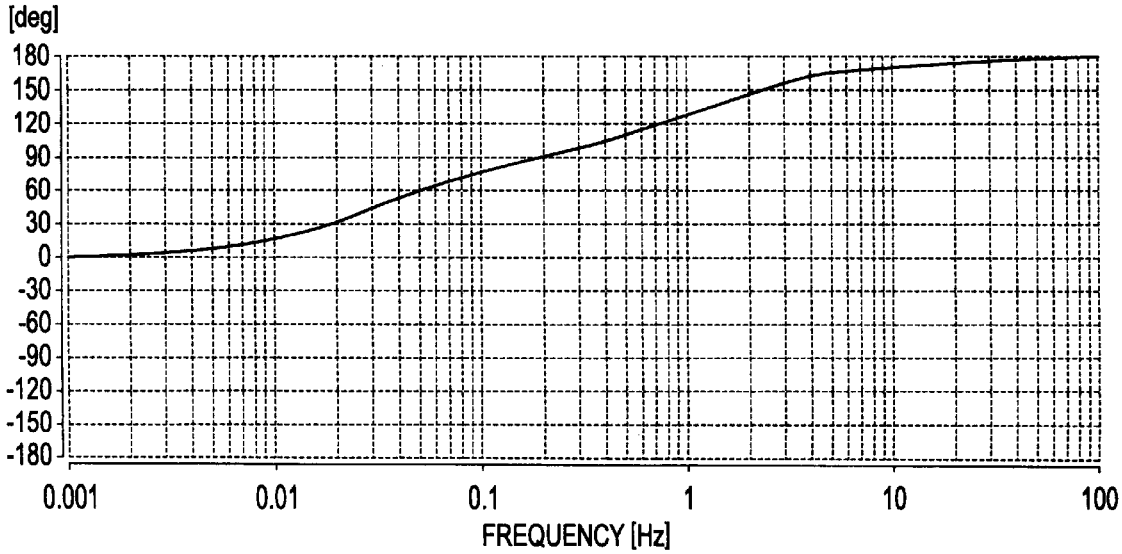

FIGS. 8A and 8B show an example of plotting the frequency characteristic of $W_T$ by a Bode diagram.

By the above-described operation, state equations of the generalized plant shown by FIG. 5 are calculated by Equation (3-8) shown below.

$$\frac{d}{dt}\begin{bmatrix}\zeta_1\\ \zeta_2\\ \zeta_3\\ \zeta_4\\ \zeta_5\\ \zeta_6\end{bmatrix}=\begin{bmatrix}0&1&0&0&0&0\\0&0&1&0&0&0\\0&0&0&1&0&0\\0&0&0&0&1&0\\0&0&0&0&0&1\\-a_0&-a_1&-a_2&-a_3&-a_4&-a_5\end{bmatrix}\begin{bmatrix}\zeta_1\\ \zeta_2\\ \zeta_3\\ \zeta_4\\ \zeta_5\\ \zeta_6\end{bmatrix}+\begin{bmatrix}0&0\\0&0\\0&0\\0&0\\0&0\\0&0\end{bmatrix}\begin{bmatrix}w_1\\ w_2\end{bmatrix}+\begin{bmatrix}0\\0\\0\\0\\0\\-a_6\end{bmatrix}u_g \tag{3-8}$$

$$\begin{bmatrix}z_1\\ z_2\end{bmatrix}=\begin{bmatrix}b_0&b_1&b_2&b_3&b_4&b_5\\0&0&0&0&0&0\end{bmatrix}\begin{bmatrix}\zeta_1\\ \zeta_2\\ \zeta_3\\ \zeta_4\\ \zeta_5\\ \zeta_6\end{bmatrix}+\begin{bmatrix}0&0\\0&0\end{bmatrix}\begin{bmatrix}w_1\\ w_2\end{bmatrix}+\begin{bmatrix}0\\ \varepsilon\end{bmatrix}u_g$$

$$y_g=[\,c_0\ \ c_1\ \ c_2\ \ c_3\ \ c_4\ \ c_5\,]\begin{bmatrix}\zeta_1\\ \zeta_2\\ \zeta_3\\ \zeta_4\\ \zeta_5\\ \zeta_6\end{bmatrix}+[\,0\ \ 1\,]\begin{bmatrix}w_1\\ w_2\end{bmatrix}$$

Incidentally, notations $a_0$, $a_1$, $a_2$, $a_3$, $a_4$, $a_5$, $a_6$, $b_0$, $b_1$, $b_2$, $b_3$, $b_4$, $b_5$, $c_0$, $c_1$, $c_2$, $c_3$, $c_4$ and $c_5$ designate coefficients of respective terms when a result of respectively substituting Equation (3-5), Equation (3-6) and Equation (3-7) for the term of $W_T\cdot P\cdot C$ and the term of $P\cdot C$ and developing the denominator and the numerator of the transfer function, is defined by Equation (3-9), shown below.

$$W_T\cdot P\cdot C=\frac{b_0+b_1s+b_2s^2+b_3s^3+b_4s^4+b_5s^5}{a_0+a_1s+a_2s^2+a_3s^3+a_4s^4+a_5s^5+a_6s^6} \tag{3-9}$$

$$P\cdot C=\frac{c_0+c_1s+c_2s^2+c_3s^3+c_4s^4+c_5s^5}{a_0+a_1s+a_2s^2+a_3s^3+a_4s^4+a_5s^5+a_6s^6}$$

The H∞ control problem is solved by the state equations of Equation (3-8) to thereby calculate the amount H, and the transfer function K of the mold level control apparatus 20 is calculated by Equation (3-4).

Figure 9A:
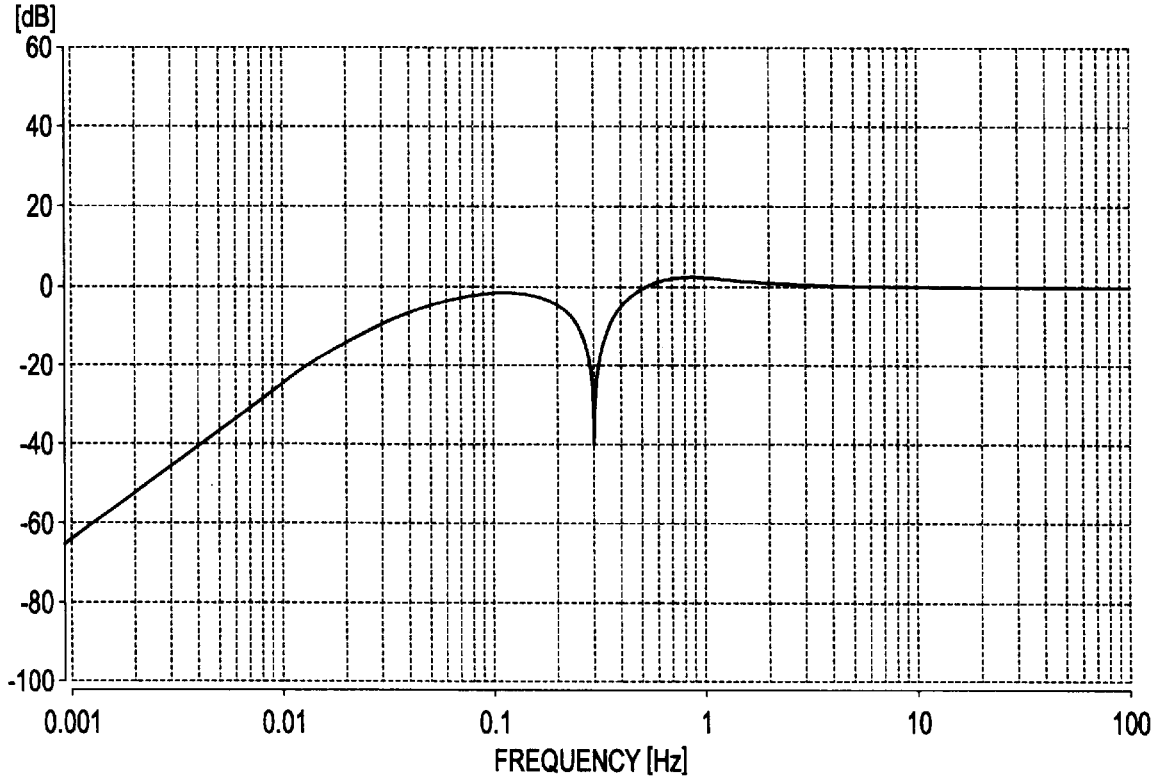
Figure 9B:
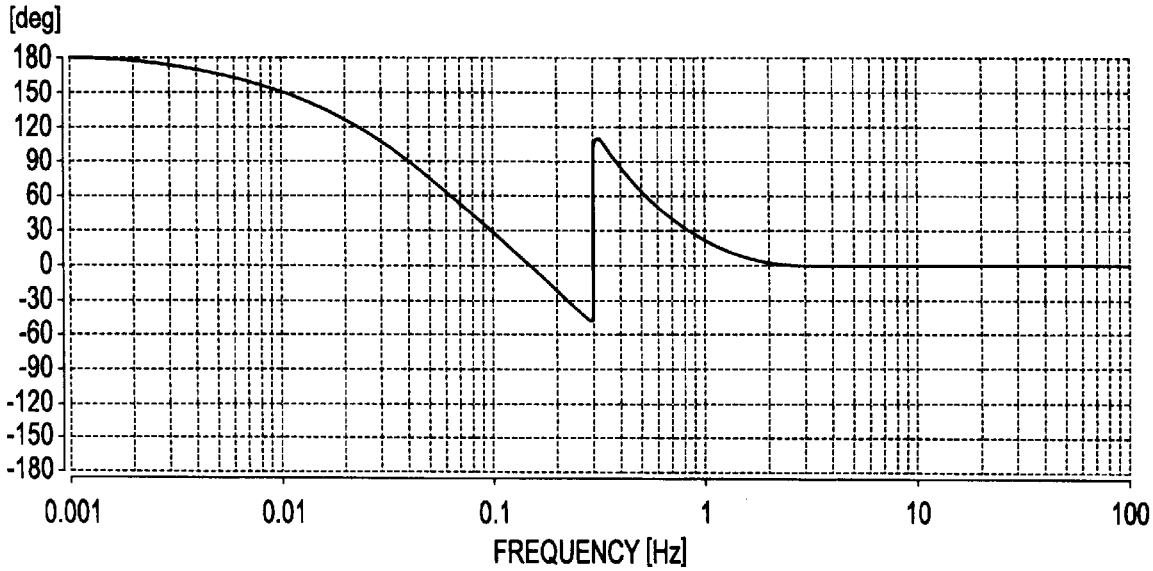

FIGS. 9A and 9B show a result of plotting the frequency characteristic of the control loop sensitivity function S using the calculated transfer function K of the mold level control apparatus 20 by a Bode diagram. According to FIGS. 9A and 9B, it is recognized that a sharp valley of the gain curve is present at the periodic disturbance frequency and it is known that there is an effect of restraining the periodic disturbance flowing into the mold 10. In the examples of FIGS. 9A and 9B, the assumed period of the periodic disturbance is set to 0.3 (Hz).

The period of the periodic disturbance produced in operating the continuous casting facility is changed depending on a situation of a change in the casting speed or the like. In correspondence therewith, the disturbance restraining function of the mold level control apparatus 20 is optimized to thereby enable to restrain oscillation of the mold level in any operational state. This is accomplished by making the frequency of the periodic disturbance flowing into the mold 10 coincide with the frequency at the valley of the gain curve in the Bode diagram of the control loop sensitivity function S. In other words, the oscillation frequency $\omega_n$ in Equation (3-6) is set to the frequency of the periodic disturbance. For that purpose, the following methods are needed.

(1) It is known that the frequency of the periodic disturbance is substantially equal to a value of the casting speed divided by the interval between rolls and therefore, the frequency of the periodic disturbance is assumed by detecting the casting speed.

(2) The temporal transition of the detected value of the mold level is processed by using, for example, high speed frequency Fourier transformation (FFT) calculation and the oscillation frequency of the mold level which is problematic in view of operation is detected.

By the above-described methods, the desired oscillation frequency $\omega_n$ of the transfer function of the mold level control apparatus 20 may be estimated and the mold level control apparatus 20 may be rescheduled in accordance with the situation.

Specifically, the following first and second methods are applied. According to the first method, there are previously prepared a plurality of transfer functions of the mold level control apparatus 20 having different oscillation frequencies $\omega_n$ and among these, in accordance with the situation, an optimum transfer function of the mold level control apparatus 20 is selected and switched for use. According to the second method, a procedure of calculating the transfer function of the mold level control apparatus 20 is automated and during the operation, in accordance with the situation, there is used the transfer function of the mold level control apparatus 20 calculated by executing the procedure. These are executed at a periodic disturbance frequency adapting unit 25 of FIG. 2, to be mentioned later.

Figure 2:
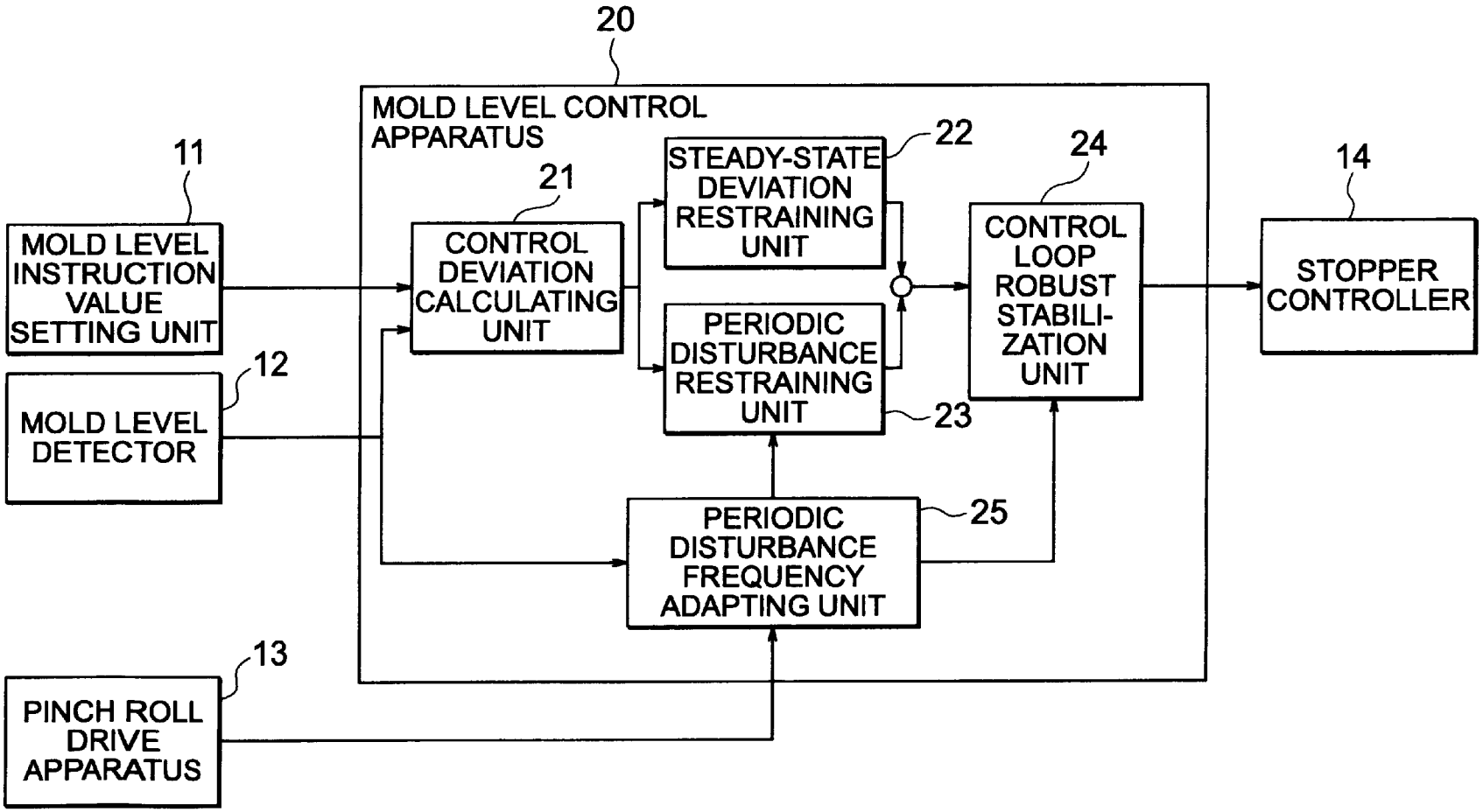
FIG. 2 is a block diagram showing an example of a mold level control apparatus and constitutions accompanied thereby according to the invention.

FIG. 2 shows the constitution of the mold level control apparatus 20 according to the invention and elements accompanied thereby and an explanation will be given of the functions of respective constituent elements.

(1) Mold level instruction value setting unit 11

The mold level instruction value setting unit 11 sets an instruction value of the mold level and outputs a mold level instruction value signal.

(2) Mold level detector 12

The mold level detector 12 detects the level of the molten steel in the mold and outputs a mold level detected value signal.

(3) Pinch roll drive apparatus 13

The pinch roll drive apparatus 13 is arranged on the downstream side of the mold for transferring the produced slab to the downstream side and outputs a casting speed detected value signal.

(4) Stopper controller 14

The stopper controller 14 receives a stopper operating amount signal outputted from the mold level control apparatus 20 and controls the stopper based on a stopper operating amount signal.

(5) Control deviation calculating unit 21

The control deviation calculating unit 21 is provided with the mold level instruction value and the mold level detected value from the mold level instruction value signal and the mold level detected value signal, calculates a mold level control deviation (that is, a state amount produced by subtracting the mold level detected value from the mold level instruction value) and outputs a mold level control deviation signal.

(6) Steady-state deviation restraining unit 22

The steady-state deviation restraining unit 22 calculates a mold level steady-state deviation restraining state amount by the second term in Equation (3-6) and outputs a mold level steady-state deviation restraining signal indicating the state amount. Owing to the integration characteristic of the second term in Equation (3-6), when the steady-state deviation continues for a long period of time, the mold level steady-state deviation restraining state amount is gradually increased and operates to restrain the mold level steady-state deviation. The steady-state deviation restraining unit 22 operates similar to that in the same constitution as the integration term of the conventional PI controller.

(7) Periodic disturbance restraining unit 23

The periodic disturbance restraining unit 23 calculates a mold level periodic disturbance restraining state amount according to the first term of Equation (3-6) and outputs a mold level periodic disturbance restraining signal indicating the state amount. As described above, the periodic disturbance restraining unit 23 is provided with a significant feature in that the periodic disturbance restraining unit 23 is provided with a control element oscillating at a frequency equal to the periodic disturbance frequency at the inside thereof. The periodic disturbance restraining unit 23 is provided with a property in which when the mold level detected value (and accordingly, the mold level control deviation) oscillates at the above-described periodic disturbance frequency, the above-described control element is stimulated and oscillates in synchronism with the above-described periodic disturbance frequency. By the resonant state, the large mold level periodic disturbance restraining state amount is formed. This shows that even in a state in which a degree of the oscillatory state of the mold level is small, that is, an amplitude of the mold level control deviation is small, the large mold level periodic disturbance restraining state amount is promptly formed. By this property, the oscillatory state is restrained during a time period in which the self-increasing fluctuation of the mold level is small, that is, stable operation is not hindered to thereby achieve the problem of the invention. Further, an explanation has been given in the specification by ascribing the property to the property of the control loop sensitivity function S.

(8) Control loop robust stabilization unit 24

The control loop robust stabilization unit 24 calculates the stopper operating amount so that the mold level control loop by the mold level control apparatus establishes robust stability by receiving the mold level steady-state deviation restraining signal and the mold level periodic disturbance restraining signal, and outputs a stopper operating amount signal. The control loop robust stabilization unit 24 carries out a calculation represented by the transfer function H in the specification.

When the stopper operating amount is calculated based on a sum of the mold level steady-state deviation restraining state amount and the mold level periodic disturbance restraining state amount, there is a case in which the control loop becomes unstable. That is, when the periodic disturbance frequency is high and is proximate to a crossover frequency of the control loop, there can cause a situation in which there are no margin of gain and no margin of phase in the control loop. Further, even otherwise, as described above, there can be predicted a case in which the control loop becomes unstable by the influence of a modeling error which is omitted from the investigation on, for example, the molten steel drop time or the dead zone of the stopper actuator or by a variation in the characteristic of the control object of the mold level which is unexpectedly caused in operating the continuous casting facility.

Hence, according to the invention, the above-described two problems are resolved by ascribing the problems to the H∞ control problem.

(9) Periodic disturbance frequency adapting unit 25

The periodic disturbance frequency adapting unit 25 changes calculation characteristics of the periodic disturbance restraining unit 23 and the control loop robust stabilization unit 24 by recemng the mold level detected value signal and the casting speed detected value signal. As has been described in explaining the periodic disturbance restraining unit 23, the feature of the mold level control apparatus 20 according to the invention resides in that the periodic disturbance restraining unit 23 is provided with the control element oscillating at the frequency equal to the periodic disturbance frequency to thereby remarkably promote the function of restraining the periodic disturbance. However, the periodic disturbance frequency is changed depending on various conditions in operating the continuous casting facility. When the frequency of the oscillation control element provided to the mold level control apparatus is different from the periodic disturbance frequency, the effect of the mold level control apparatus is reduced. Hence, the periodic disturbance frequency adapting unit 25 is constituted to change the transfer function K of the mold level control apparatus 20 as necessary by the above-described value produced by dividing the casting speed by the roll interval or by the measure described at the paragraph of FFT.

Further, such a mold level control apparatus 20 can be realized by a computer.

Figure 10:
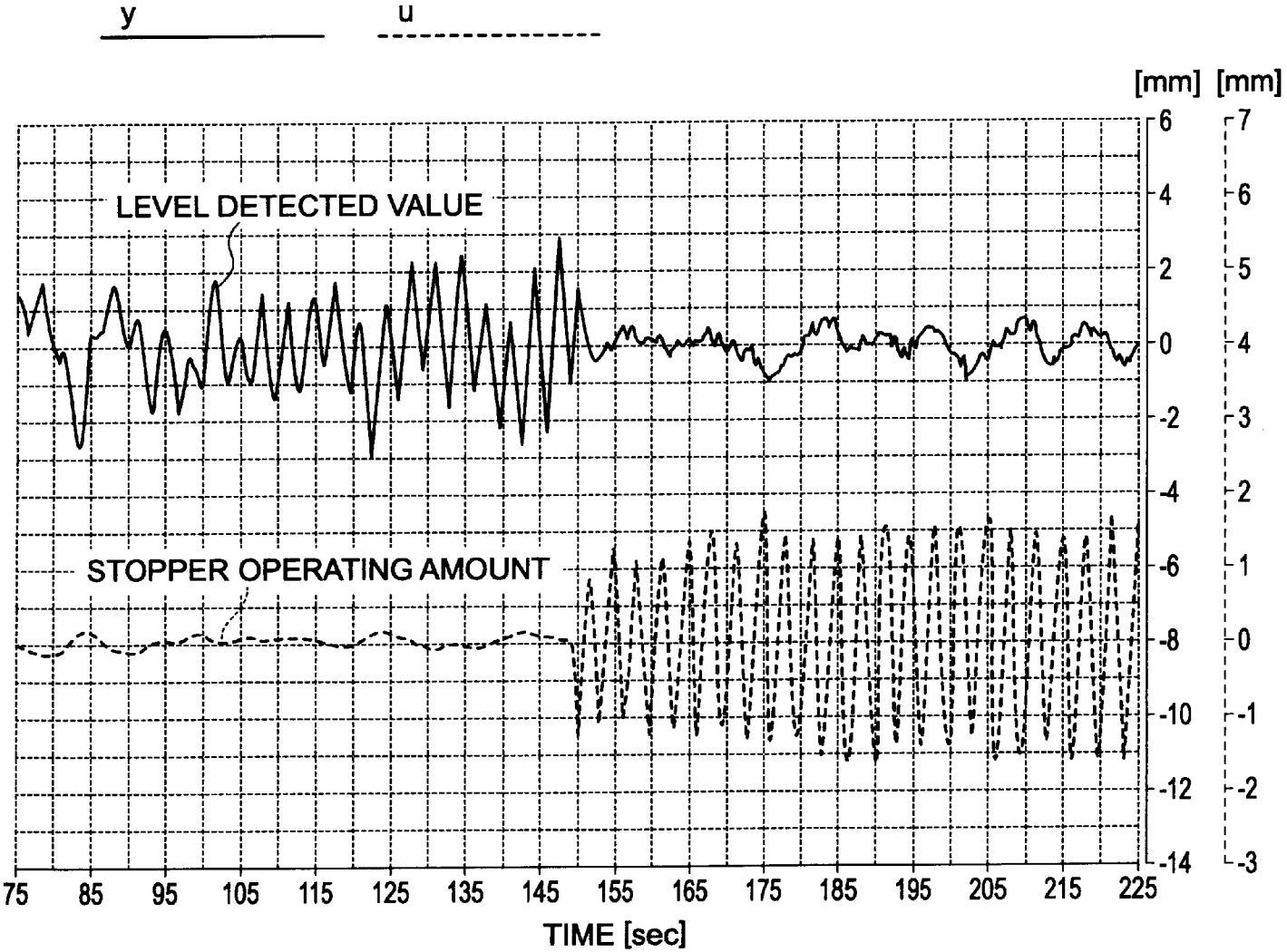
FIG. 10 is a diagram showing a measurement result for explaining an effect of the mold level control apparatus according to the invention in comparison with a conventional example.

FIG. 10 shows a result of applying the mold level control apparatus according to the invention. In FIG. 10, a waveform of a solid line on the upper side indicates the temporal transition of the mold level detected value, and a waveform of a dashed line on the lower side indicates the temporal transition of the stopper operating amount.

In order to show the effect of the mold level control apparatus, FIG. 10 shows a behavior in which a state of control by the conventional PI control system is switched to a state of control by the mold level control apparatus. That is, up to 150 seconds of time axis, there is shown a situation in which the mold level is controlled by the conventional PI controller. There is shown a situation in which at the time point of 150 seconds, the control is switched to that of the mold level control apparatus and thereafter, the mold level is controlled by the mold level control apparatus.

According to FIG. 10, there is known a behavior in which in a time period in which the control is carried out by the PI controller, the mold level is vehemently oscillated and further, the amplitude is gradually increased. On the other hand, there is known a behavior in which after switching to the mold level control apparatus, the oscillation is swiftly converged and the mold level is stably controlled. The behavior justifies the study underlying the invention which has been described, and shows that the invention achieves its object.

Incidentally, a specific numerical value of the effect of restraining the periodic level fluctuation according to the conventional control system falls in a range of 20 through 30 (%) whereas according to the invention, there is achieved the effect of restraining the periodic level fluctuation of 96.7 (%) or higher.

As has been explained, according to the invention, there can be provided the mold level control apparatus capable of stably and constantly controlling the mold level even when the apparatus undergoes the influence of the periodic disturbance in the mold level.

What is claimed is:

1. A mold level control apparatus having a mold level detector for detecting a mold level in a mold and outputting a mold level detected value signal indicating a mold level detected value, and controlling a stopper or a sliding gate to maintain constant the mold level in a continuous casting facility, said mold level control apparatus comprising:

a control deviation calculating unit for calculating a mold level control deviation by the use of a mold level instruction value signal and the mold level detected value signal, and outputting a mold level control deviation signal indicating the mold level control deviation;

a steady-state deviation restraining unit for calculating a mold level steady-state deviation restraining state amount by using the mold level control deviation signal, and outputting a mold level steady-state deviation restraining signal indicating the mold level steady-state deviation restraining state amount;

a periodic disturbance restraining unit having a control component oscillated at a frequency equal to a frequency of a periodic disturbance of the mold level, calculating a mold level periodic disturbance restraining state amount by using the mold level control deviation signal, and outputting a mold level periodic disturbance restraining signal indicating the mold level periodic disturbance restraining state amount;

a control loop robust stabilization unit supplied with the mold level steady-state deviation restraining signal and the mold level periodic disturbance restraining signal, calculating an operating amount of the stopper or the sliding gate so that a mold level control loop constituted by the mold level control apparatus is brought into robust stability, and outputting an operating amount signal indicating the operating amount; and a periodic disturbance frequency adapting unit supplied with the mold level detected value signal and a casting speed detected value signal and detecting an oscillatory frequency of the mold level as a frequency of the periodic disturbance, and changing calculation characteristics of the periodic disturbance restraining unit and the control loop robust stabilization unit based on a result of the detection.

2. The mold level control apparatus according to claim 1:

wherein the periodic disturbance frequency adapting unit detects the oscillatory frequency of the mold level from the casting speed detected value and an interval between rolls arranged on a downstream side of the mold.

3. The mold level control apparatus according to claim 1:

wherein the periodic disturbance frequency adapting unit processes a temporal transition of the mold level detected value by high-speed Fourier transformation and detects the oscillatory frequency of the mold level.

* * * * *